United States Patent [19]

Gore

[11] 4,129,754

[45] Dec. 12, 1978

[54] REPORTING DEVICE

[76] Inventor: Thomas A. Gore, Edina, Mo. 63537

[21] Appl. No.: 812,138

[22] Filed: Jul. 1, 1977

[51] Int. Cl.[2] ..... H04R 1/08

[52] U.S. Cl. ..... 179/188; 181/242

[58] Field of Search ..... 179/188; 181/242

[56] References Cited

U.S. PATENT DOCUMENTS

| | | | |
|---|---|---|---|
| 2,508,581 | 5/1950 | Morrow | 179/188 |
| 2,745,911 | 5/1956 | Webb | 179/188 |
| 2,830,135 | 4/1958 | Webb | 179/188 |
| 2,855,067 | 10/1958 | DiMattia | 181/242 |
| 2,857,013 | 10/1958 | Orso | 179/188 X |
| 3,114,802 | 12/1963 | Beguin | 179/188 |
| 3,796,842 | 3/1974 | Guille | 179/188 |

*Primary Examiner*—Thomas W. Brown

*Attorney, Agent, or Firm*—Glen R. Simmons

[57] ABSTRACT

A hand-held reporting device for use in environments wherein a minimum of sound in connection with use of the device is a priority and in environments having a high level of noise intensity. The device includes a barrel with a bell-shaped top, the latter preferably being set at an angle with respect to the barrel. A microphone is positioned at the end of the barrel remote from the bell-shaped top. The barrel portion and a portion of the bell-shaped top are lined with foam urethane to muffle noise and absorb moisture. The reporting device includes means for permitting pressurized air within the device to escape to the outside via an air communication channel from inside the device through a portion of the face piece of the device to the outside.

17 Claims, 8 Drawing Figures

Fig. 3.
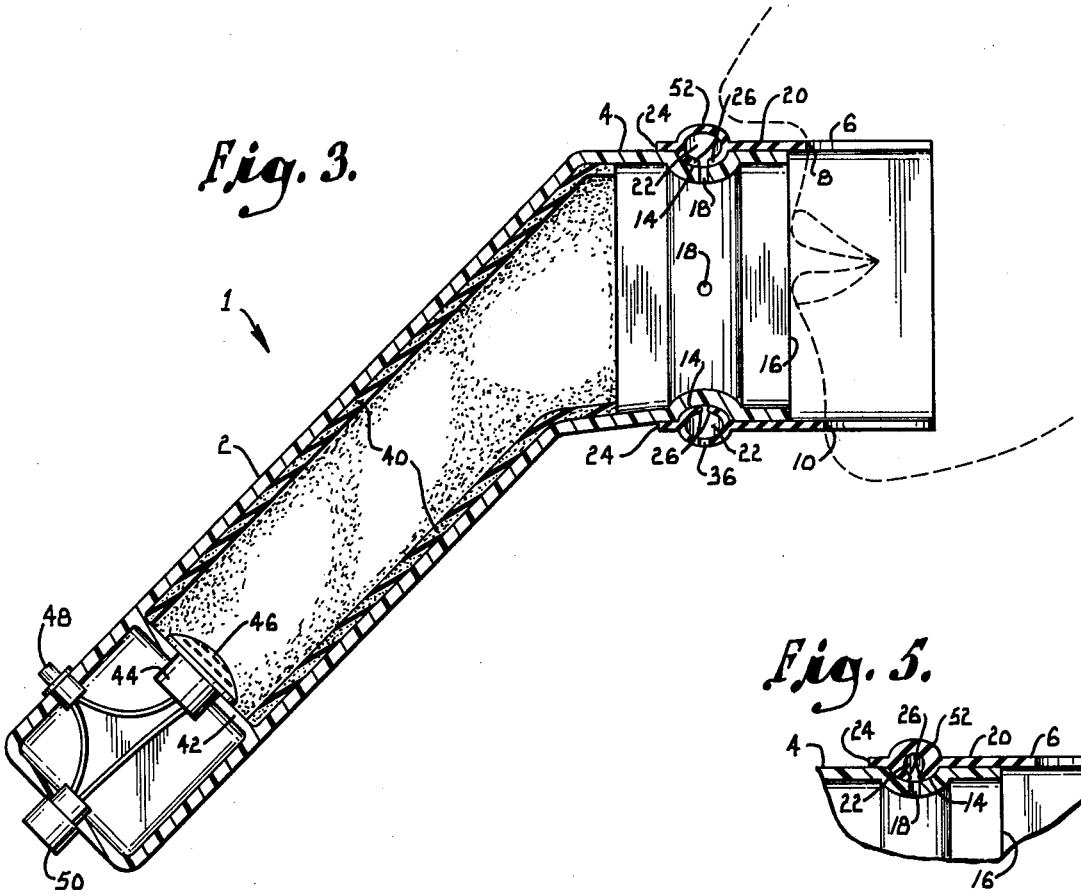
Fig. 5.
Fig. 4.
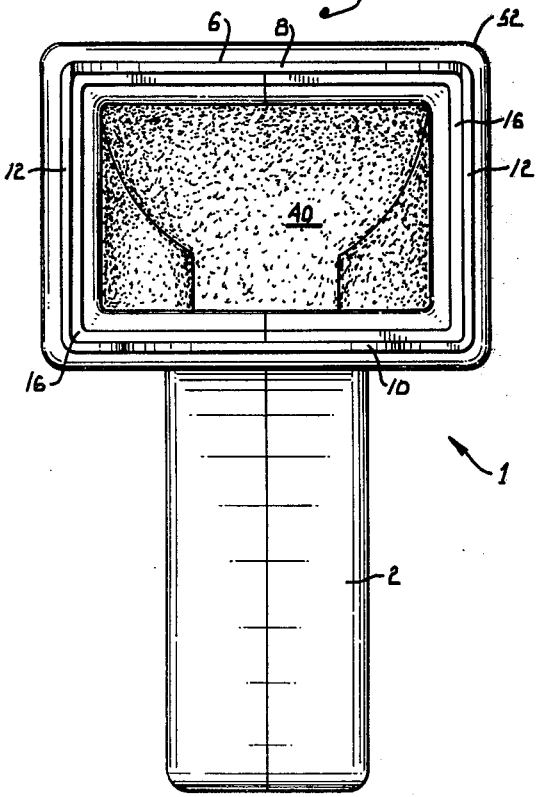
Fig. 6.
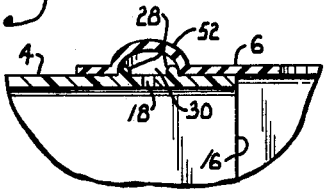
Fig. 7.
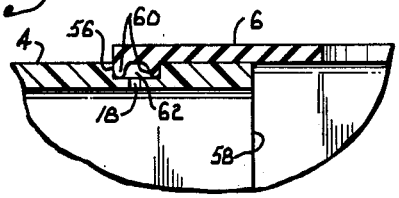

REPORTING DEVICE

BACKGROUND AND OBJECTS OF THE INVENTION

There has been a continuing problem in attempting to report and record information in environments where there is a high intensity noise level, as well as in environments where it is desirable that no additional noise be produced by the reporting and recording process such as in the field of court reporting, classroom instruction, and in x-ray viewing rooms of radiology departments.

Examples of the prior art may be seen in the following U.S. Pat. Nos.: AAGAARD, 1,474,100; Gerlach, 1,776,584; Gilman et al, 2,485,278; Junghans, 2,806,906; Orso, 2,857,013; Beguin, 3,114,802 and 3,796,842.

An advantage of the applicant's device over the prior art is in the fact that the applicant's device does not cover the user's nose, rather it covers only the user's mouth area. Thus, the applicant's device in no way interferes with the device user's breathing or with the positioning of glasses the user may be wearing.

Further, use of the "mask" type reporting device requires provision there within for breathing by the user since the user's nose is covered by the mask while the device is in use.

Further, in the prior art devices there has been a problem of dealing with the moisture accumulation within the sound chamber of the device. The moisture accumulation is concomitant with device usage because of the presence of moisture in the user's breath. Heretofore, there has been no satisfactory arrangement for absorbing the moisture within the reporting device.

A further problem in the device of the prior art has been the signal distortion generated by the mechanical-electrical transducer of the device. Specfically, the heretofore devices have positioned the transducer or microphone of the device in other than an optimum position for signal fidelity achievement.

A further problem with prior art devices has been the pressure build-up within the device when the user speaks while having the device pressed against his or her mouth. The pressure build-up tends to mitigate the effectiveness of the transducer operation and promotes distortion and a low signal to noise ratio from the transducer.

Accordingly, it is an object of the invention to provide a reporting device capable of providing a high signal to noise ratio while operating in an environment having a high intensity noise level.

Further, it is an object of the invention to provide a reporting device capable of providing a signal having good fidelity when used in environments requiring that sound produced by the reporting and recording process be kept to a minimum.

A further object of the invention is the provision of a reporting device having a design such that the use of such device in no way interferes with glasses worn by the user.

A further object of the invention is to provide a reporting device which does not cover the nose when in use.

A further object of the invention is to provide a reporting device which in no way interferes with the user's breathing while in use.

A further object of the invention is to provide a reporting device which is free of problems caused by breath moisture accumulation within the device.

A further object of the invention is the provision of a reporting device which has optimum positioning of a mechanical-electrical transducer within the device such as to produce a low distortion electrical signal in response to a human voice.

A further object of the invention is the provision of a reporting device structurally arranged such as to minimize distortion in the device transducer output signal caused by employment of the device in proximity to the mouth of the user.

The invention has as a further object the provision of a reporting device which mitigates the harmful phenomena produced by pressure build-up in the sound channel of the device when the user speaks while having the device pressed against his or her mouth.

A further object of the invention is to provide a reporting device having means to relieve pressure build-up in the device's sound channel when a user speaks while having it pressed against his or her mouth area.

A further object of the invention is to provide a reporting device readily usable in court rooms without adverse effect on the proceedings.

A further object of the invention is provision of a device readily usable by blind people in situations where a record of audible sounds is desirable but where normal type recording would be prohibited.

A further object of the invention is to provide a reporting device for classroom dictation recordation by both blind and seeing students.

A further object of the invention is to provide a reporting device readily usable by radiologists in dictating reports in the x-ray scanning rooms.

Further objects, advantages and details of the reporting device will be apparent from the following detailed description of preferred embodiments of the invention.

BRIEF DESCRIPTION OF THE DRAWINGS

FIG. 3 is a section view taken along the line of 3-3 in FIG. 1.

FIG. 4 is a front view of the device of the invention.

FIG. 5 is an enlarged detail view of the pressure escape structure of the invention.

FIG. 6 is an enlarged detail view of an alternative embodiment of the pressure release arrangement.

FIG. 7 is an enlarged detail view in section of an alternative pressure escape arrangement of the invention.

DESCRIPTION OF THE PREFERRED EMBODIMENT

Figure 1:
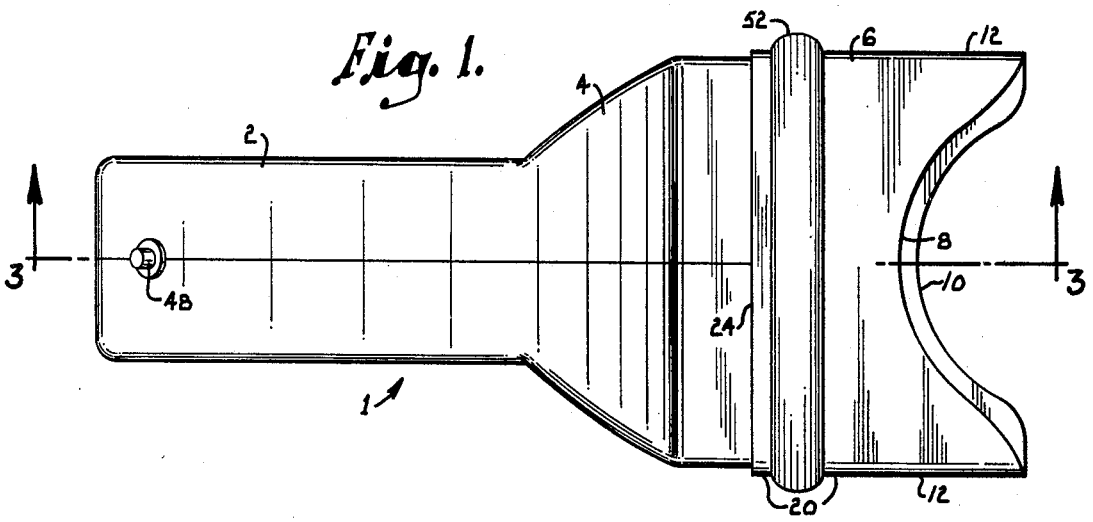
FIG. 1 is the top plan view of the device of the invention.
Figure 2:
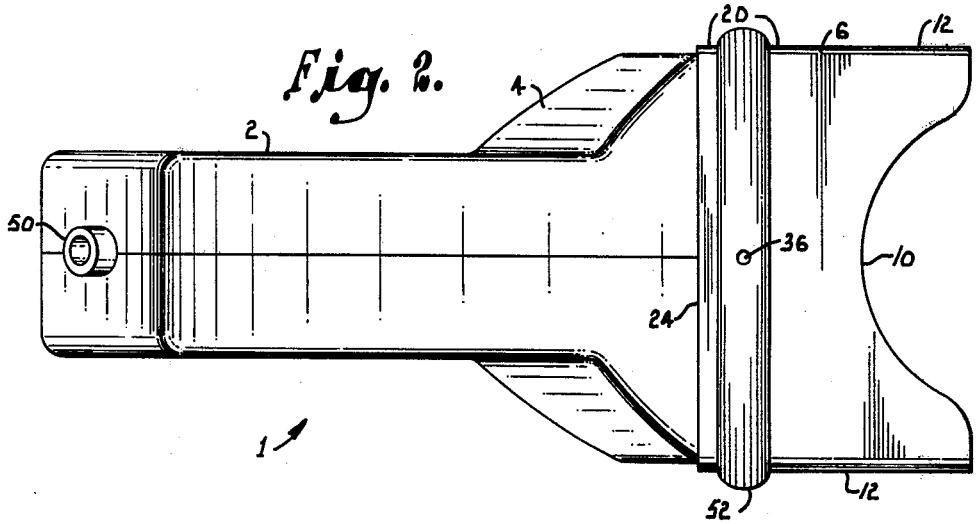
FIG. 2 is a bottom view of the device of the invention.

Referring now to the drawings wherein like numerals refer to like parts throughout, there is shown the reporting device of the invention. Referring to the drawings generally and particularly to FIG. 1 there is seen a general reference 1 to the reporting device which has a hollow main body or barrel portion 2 and a bell shaped or flared top portion 4. Positioned on top portion 4 is a face piece 6 which comes in contact with the user's face. Specifically, face piece 6 has edge 8 along the front top thereof which is curved as seen in FIG. 1 and which comes in contact with the user's face below the columnella of the nose and against the upper lip above the Vermillion border thereof as seen in FIG. 3. Further, face piece 6 has a lower front edge 10, which is curved as seen in FIG. 2 and which comes in contact with the user's face in the area of the chin or lower lip below the Vermillion border thereof. Sides 12 of the face piece 6 come in contact with the user's cheek areas on either side of the mouth. Face piece 6 is preferably made of rubber or other deformable material and varies in hardness and rigidity from being very soft and deformable in the area which comes in contact with the user's face to being relatively hard and rigid in the area which is in contact with the top portion 4 of the device.

As generally seen in FIG. 3 and as specifically seen in FIG. 5 top portion 4 has located therein a rounded bottom groove 14 which extends completely around the outside of top portion 4. The groove 14 is spaced near the front edge 16 of top portion 4 and parallel thereto. At a plurality of points around groove 14 in the bottom thereof there is an orifice 18 connecting the bottom of groove 14 with the sound channel or the interior of top portion 4 and barrle 2. Preferably there are three orifices connecting the interior of the device with the bottom of groove 14; one on each side and one on the top. The purpose of the orifices is to allow air to pass from the interior chamber of the device to the outside for pressure release as described hereinafter. Of course, the specific number of orifices could be increased or reduced as needed to mitigate pressure build up.

Face piece 6 is, as previously noted, made of rubber or other deformable material and has a portion thereof generally referred to as 20 stretched over the front portion of top part 4 of the device. The inside perimeter of face piece 6 is slightly smaller than the outside perimeter of top portion edge 16. Thus portion 20 of piece 6 is stretched and pulled on to flared part 4 over edge 16 to a position as hereinafter described. As seen in FIGS. 3 and 5, face piece 6 has an O-shaped hollow ring 22 formed therewithin. Ring 22 is formed within the material of face piece 6 and is open on the interior side. The O-ring runs completely around piece 6 as seen in the drawings and is parallel to the back edge of 24 of piece 6. The extensions 26 of 20 which define the O-ring on the open side thereof project in an arcuate fashion inwardly on the interior of piece 6.

As seen in FIG. 5, face piece 6 is positioned on top 4 such that O-ring 22 and extensions 26 coincide with groove 14. Specifically, the hollow portion of O-ring 22 is in direct communication with orifices 18 such that when piece 6 is properly positioned, air can pass from the interior of 2 and 4 through 18 into 22.

As seen only in FIGS. 2 and 3, there is an aperture 36 through piece 6 which communicates with hollow O-ring 22 on the bottom side of the reporting device to permit air to flow between 22 and outside the device.

When the user presses the reporting device against his/her mouth area as described above the interior chamber of the device has heretofore become air tight for all practical purposes. Any attempt to speak into such air tight chamber resulted in a pressure build-up within the device and at best only an inaudible or unintelligible signal is produced by the associated transducer for recordation.

However, in the device of this invention is provided by the above-described structural arrangement an escape for any pressure build-up, to-wit: when air pressure increases inside the sound channel of the reporting device, air escapes through orifices 18 into hollow O-ring 22 thence circumferentially within 22 to aperture 36 where it escapes to the outside. This arrangement provides a two-fold purpose: (1) it vents air to the device exterior and prevents pressure build-up within the device thus mitigating any reduction in signal fidelity which accompanies pressure build-up in such device, and (2) muffles any sound of the user's voice from escaping to the exterior of the device while such pressure venting takes place.

An alternative structural arrangement is shown in FIG. 6 wherein ridges 28 are molded into part 4 and continue around the periphery of 4 and have one or more orifices 18 therebetween. In this arrangement a channel or groove 30 is molded into face piece 6 which is position on 4 such that channel 30 straddles ridges 28 in order that 18 communicate with channel 30. In this arrangement as with the arrangement of FIG. 5, there is an aperture (not shown) from 30 to the outside through 6 in order that air may escape from the interior of 4 into 30 thence circumferentially to said aperture and then to the outside of the device.

Barrel 2 and top portion 4 are made of molded urethane and preferably are of a rectangular cross-section although they may be of a square or circular cross-section.

The barrel 2 of the device preferably is on the order of 1½ to 2 inches by 1½ to 2 inches in cross-section dimensions while the area of top portion 4 is 3½ to 4 inches by approximately 2¼ inches across. Face piece 6 preferably tapers slightly from 20 toward the edges 8 and 10 and sides 12 to provide an opening approximately 2¼ inches by 3½ to 4 inches into which the user speaks. The overall length of the device is preferably 9 to 12 inches. Of course, these dimensions may vary somewhat in practice and yet be within the scope of applicant's invention.

The interior surface of barrel 2 and a portion of top 4, as seen in FIG. 3, are lined with urethane foam 40 having a thickness of approximately ⅛ inch. The urethane foam 40 serves to absorb breath moisture within the device and further serves to muffle the sound of the user's voice and prevent same from being heard outside the device.

At the lower end of barrel 2 there is located a partition 42 extending across barrel 2. Partition 42 has a hole 44 cut in the center thereof and mounted within said hole is transducer 46. Transducer 46 is preferably round in shape as one views it down barrel 2 and is approximately 1¼ inches in diameter. A suitable transducer 46 is manufactured by the Turner Microphone Company and it is preferable to use a transducer which may serve as both microphone and speaker in order that the user may playback the recorded information and listen to it by placing the device with face piece 6 adjacent his/her ear. Electrically connected to transducer 46 is pause button and associated switch 48 which is shown mounted in the top side of barrel 2. Electrically connected to both pause button 48 and transducer 46 is a suitable plug 50 which is mounted in the end of barrel 2. Plug 50 is adapted for use with any existing recording device suitable for use in the environments above described. While pause button 48 has been shown as mounted on the lower end of barrel 2 it, of course, can be mounted anywhere on barrel 2 which is convenient for the user to apply pressure by a thumb or finger and top or start the recording process. Further, the switch associated with pause button 48 may be of the normally closed or normally open variety depending upon the user's choice in whether he desires to normally keep the button down during recordation and to release it during pauses or whether he desires to normally leave the button up and to press it during pauses. Under either arrangement, pause button 48 and associated switch serve to enable the user of the device to temporarily interrupt recordation when desired. Of course, the associated recording device, whether cassette or otherwise, will have the usual controls placed on recording devices commercially available.

In lieu of foam urethane 40, a liner made of grooved cardboard or a collapsable plastic liner may be inserted into barrel 2 and top 4 to absorb moisture.

While hollow O-ring 22 in piece 6 as shown in FIG. 5 has been described above as being open on the interior side, i.e., it is open to channel 14 all the way around top position 4, an acceptable alternative arrangement is simply to have apertures in 6 from the inside thereof which communicate with 22. In this arrangement, the apertures (not shown) through 6 would have to coincide with the location of orifices 18 in order that air may move from the interior of 2 and 4 through 18 and then through the apertures (not shown) in 6 to O-ring 22 thence around 22 to aperture 36 where the air escapes to the outside. This arrangement requires accurate positioning of piece 6 to insure communications between 18 and O-ring 22 while under the open O-ring arrangement as long as the O-ring portion of 6 was positioned in groove 14, apertures 18 would necessarily be in communication with 22 by reason of the positioning.

Transducer 46 has been found to be advantageously positioned at the lower end of barrel 2 on partition 42 as seen in FIG. 3. This optimum positioning, with material 40 lining the sound channel toward the user's mouth, serves to mitigate the problem of moisture reaching the transducer 46 and serves to mitigate the distortion caused by use of a microphone transducer in close proximity to the user's mouth. Transducer 46 and partition 42 are preferably located within 2–2½ inches of the end of barrel 2 having plug 50 therein.

Further, while barrel 2 and top 4 may be linear, if desired, it has been found preferable to set the top portion 4 at an angle with respect to barrel 2. This arrangement has been found to further mitigate distortion in the signal generated by transducer 46.

If desirable, a light may be mounted in or on barrel 2 and inserted in circuit with transducer 46 and button-switch 48 to indicate when recordation is in process.

As above noted, transducer 46 is preferably of the kind which can be used as a microphone for recording and as a speaker for playback. When the associated recording device is in the playback mode of operation, as noted above, the device user places piece 6 against his/her ear and listens to the sound produced by 46. Of course, 46 need not be a playback transducer, but may be only a microphone for recording if desired with other arrangements made for the playback mode.

In portion 20 of face piece 6, the presence of hollow O-ring 22 or 30 causes a hump or raised ring 52 which is visible around the outside of 6 as shown in the drawings. Of course, 6 could be of a thickness sufficient that the hollow ring would not show on the surface but the added material required to "hide" the ring 22 or 30 from the surface of 6 has not been found desirable and the visible "hump" 40 as shown in the drawings has not been found objectionable.

As noted above, FIG. 7 shows an enlarged detailed sectional view of an alternative embodiment of the pressure release arrangement. In the embodiment of FIG. 7, top portion 4 has a square cornered groove 56 therein which continues completely around the outside thereof parallel to the front edge 58 of piece 4 in like manner as groove 14 in FIG. 3. Face piece 6 in this embodiment has protruding ridges 60 extending inwardly toward piece 4 from the rear portion of piece 6 completely around the inner rear surface thereof. The spacing between ridges 60 is such as to allow said ridges to fit snugly within groove 56 when the rear end of piece 6 is pulled over the opening of top piece 4 closest to the user's face. In other words, when mounting 6, as described in the other embodiments, the end of 6 which has the ridges 60 protruding inwardly therefrom is pushed or pulled over the front edge 58 of top piece 4 onto piece 4 to the point where inwardly protruding ridges 60 nestle themselves snugly into groove 56 in part 4 leaving a ring shaped air chamber 62 extending around the top portion 4 of the reporting device under the rear of face piece 6 and between ridges 60. In the embodiment of FIG. 7, as in the other embodiments, there is a plurality of orifices 18 in piece 4 which allow air to pass between the inside of parts 2 and 4 of the reporting device and ring shaped air chamber 62. Further, in the embodiment of FIG. 7, there is an aperture in piece 6 (not shown) preferably on the bottom of the device like 36 in FIG. 3 which permits air to pass from ring shaped air chamber 62 to the outside of face piece 6. Thus in the embodiment of FIG. 7, when air pressure increases due to the user speaking into the opening of face piece 6, air moves from inside 2 and 4 through one or more orifice 18 into 62 thence circumferentially around 62 to the aperture in 6 (like 36 in FIG. 3) thence through said aperture to the outside. This arrangement, as the others, permits air under pressure to escape through 18, 62 and the aperture in 6 to the outside while muffling and preventing sound from the user's voice from escaping to the outside of the device.

While the sectional view of FIG. 3 has shown a partition 42 at the lower end of barrel 2, in lieu of an actual partition, for example, a U-shaped bracket could be mounted inside the lower end of barrel 2 with plug 50 extending through one side of the U through the end of barrel 2 as shown and transducer 46 being mounted in the other side of the U. Other type brackets could be provided within 2 for mounting transducer 46 without departing from the scope of the invention.

Face piece 6, as noted above, varies in rigidity from being relatively rigid in form adjacent bell top 4 to being very deformable in the area coming in contact with the user's face. Preferably, face piece 6 is made of homogenous rubber material with the rigidity variations being caused by thickness of the material variation i.e., face piece 6 would be of greater thickness in the areas contacting bell top 4 than in the area contacting the user's face. The idea, of course, being to have thin and thus very deformable material in the area of 6 contacting the user's face in order that while the device is pressed against the face there will be a relatively airtight connection between 6 and the face to mitigate voice sound from escaping the device.

Figure 8:
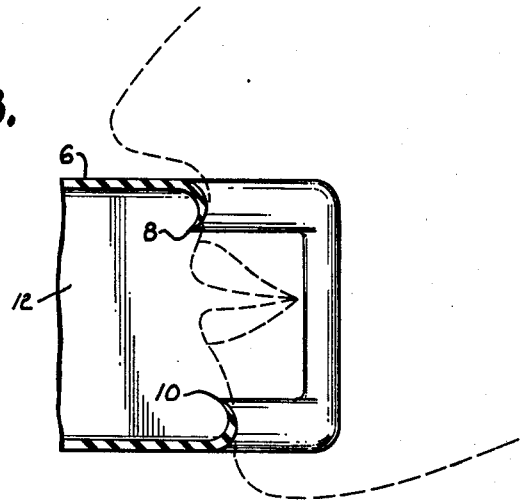
FIG. 8 is a partial sectional view of an alternative embodiment of the face piece of the device.

While the embodiment of the sectional view in FIG. 3 shows the extremities of face piece 6 as being relatively straight, experience has shown that it is advantageous to have edges 8, 10 and the extremities of 12 nearest the user's face rounded inwardly toward each other as shown in the partial cross section in FIG. 8. With the edges of 6 around the opening into which the user speaks, rounded inwardly, more consistent contact is made with the user's face and thus less sound escapes from the device while in use.

Having described my invention, I claim:

1. A reporting device comprising:

(a) an elongated housing having a closed end and an open end;

(b) a hollow face piece having two open ends and being adapted for mounting with one of said open ends positioned over said open end of said housing and in contact with said housing adjacent said open end of said housing and with the other open end thereof having means for achieving a relatively airtight contact when placed against the facial area around the mouth of the user of said device;

(c) transducer means positioned within said housing for generating an electrical signal in response to audio waves within said device;

(d) means for permitting pressurized air within said device to escape to the outside of said device when said other open end of said face piece is pressed against the facial area around the mouth of the device user and the device is in use;

(e) said means for permitting pressurized air within said device to escape to the outside further comprises a groove circumscribing said housing with at least one orifice through said housing in said groove, a channel formed within said face piece and inscribing said face piece, at least one aperture through the material of said face piece, said aperture connecting the interior of said piece with the exterior thereof with at least one aperture being located in said channel, said channel being positioned in said groove when said face piece is positioned on said housing;

whereby pressurized air within said device escapes to the exterior thereof by moving from the interior of said device through said orifice to said groove and thus into said channel in said face piece and thence through said aperture in said face piece to the exterior of said device thus enabling said transducer to generate relatively distortion free signals responsive to the user's voice.

2. A reporting device comprising:

(a) an elongated housing having a closed end and an open end, said housing being made of relatively undeformable material;

(b) a hollow face piece having two open ends and adapted for mounting one open end thereof over said open end of said housing and in airtight contact with said housing adjacent said open end of said housing except for structure as defined in provisions (d), (e) and (f) below, and the other open end thereof being adapted for placement in relatively sealed relation against the facial area around the mouth of the user of said device;

(c) a transducer means placed within said housing and adapted to at least generate an electrical signal responsive to audio waves within the device;

(d) said housing having at least one orifice therein other than said open end;

(e) said face piece having an interior surface and an exterior surface and a channel formed on the interior surface thereof with at least one aperture connecting said channel with the exterior surface of said piece;

(f) said face piece being positioned on said housing and in contact therewith such that said orifice is in communication with said channel;

whereby when the device user speaks into the said other open end of said face piece while said face piece is pressed around the mouth of the user, air pressure in said device is vented by the passage of air from within said housing through said orifice into said channel and from said channel through said aperture to the outside of said device to thereby facilitate the operation of said transducer.

3. The device of claim 2 further having moisture absorbing means and sound absorbing means located within said housing.

4. The device of claim 1 further having moisture absorbing means and sound absorbing means located within said housing.

5. The device of claim 2 wherein said housing has a barrel portion and a top portion on which said face piece is mounted, said top portion being mounted at an angle with respect to said barrel portion.

6. The device of claim 1 wherein said housing has a barrel portion and a top portion on which said face piece is mounted, said top portion being mounted at an angle with respect to said barrel portion.

7. The device of claim 2 wherein said other open end of said face piece covers the user's mouth without covering the user's nose when the device is in use.

8. The device of claim 1 wherein said other open end of said face piece covers the user's mouth without covering the user's nose when the device is in use.

9. The device of claim 2 wherein said transducer means serves as a microphone in a recordation mode and serves as a speaker in a playback mode.

10. The device of claim 1 wherein said transducer means serves as a microphone in a recordation mode and serves as a speaker in a playback mode.

11. The device of claim 2 wherein said housing has a groove located therein with said orifice being located within said groove with said face piece being placed on said housing in such position that the portion of said face piece in which said channel is formed rests within said groove.

12. A reporting device comprising:

(a) an elongated housing means having a closed end and an open end;

(b) a hollow face piece having two open ends and having an interior surface and an exterior surface and being adapted for mounting with one of said open ends positioned over said open end of said housing and in contact with said housing adjacent said open end of said housing and with the other open end thereof having means for achieving a relatively airtight contact when placed against the facial area around the mouth of the user of said device;

(c) transducer means positioned within said housing for generating an electrical signal in response to audio waves within said device;

(d) said housing having at least one orifice therein other than said open end;

(e) an air channel formed between said face piece and said housing means when the two are joined together;

(f) said face piece having an aperture from said interior surface thereof to said exterior surface thereof;

(g) said air channel being in communication with said orifice and said aperture;

whereby air can pass freely between the interior of said device and the exterior of said device via said orifice, channel and aperture while said face piece is pressed around the mouth of the user.

13. The device of claim 12 further having moisture absorbing means and sound absorbing means located within said housing.

14. The device of claim 12 wherein said housing has a barrel portion and a top portion on which said face piece is mounted, said top portion being mounted at an angle with respect to said barrel portion.

15. The device of claim 12 wherein said other open end of said face piece covers the user's mouth without covering the user's nose when the device is in use.

16. The device of claim 12 wherein said transducer means serves as a microphone in a recordation mode and serves as a speaker in a playback mode.

17. The device of claim 12 wherein said housing has a first channel located therein with said orifice being in communication with said first channel and wherein said face piece has a second channel formed on the interior surface thereof and with said aperture being in communication with said second channel and with said face piece being located on said housing in such position that said first channel is in communication with said second channel.

* * * * *